US007952479B2

(12) United States Patent
Portier et al.

(10) Patent No.: US 7,952,479 B2
(45) Date of Patent: May 31, 2011

(54) CONTAINER

(75) Inventors: Benoît Portier, Bourges (FR); Didier Lancesseur, Boulogne (FR)

(73) Assignee: Airsec S.A.S, Choisy le Roi (FR)

( * ) Notice: Subject to any disclaimer, the term of this patent is extended or adjusted under 35 U.S.C. 154(b) by 787 days.

(21) Appl. No.: 11/479,049

(22) Filed: Jun. 30, 2006

(65) Prior Publication Data

US 2008/0284567 A1 Nov. 20, 2008

(30) Foreign Application Priority Data

Jul. 1, 2005 (EP) ..... 05014386

(51) Int. Cl.
*G08B 13/14* (2006.01)

(52) U.S. Cl. ..... 340/572.1; 340/572.8

(58) Field of Classification Search ..... 340/10.1, 340/572.8

See application file for complete search history.

(56) References Cited

U.S. PATENT DOCUMENTS

| | | | | |
|---|---|---|---|---|
| 3,516,567 | A * | 6/1970 | Hemphill | 206/204 |
| 4,519,515 | A * | 5/1985 | Schonberger | 215/230 |
| 5,088,948 | A * | 2/1992 | Scheurer | 441/1 |
| 5,990,791 | A * | 11/1999 | Andreasen et al. | 340/572.1 |
| 6,366,206 | B1 * | 4/2002 | Ishikawa et al. | 340/573.1 |
| 7,149,658 | B2 * | 12/2006 | Kadaba | 702/184 |
| 2002/0027507 | A1 * | 3/2002 | Yarin et al. | 340/573.1 |
| 2002/0093427 | A1 * | 7/2002 | Roth et al. | 340/573.1 |
| 2003/0017082 | A1 * | 1/2003 | van Deursen et al. | 422/102 |
| 2003/0043039 | A1 * | 3/2003 | Salemi et al. | 340/572.8 |
| 2005/0162277 | A1 * | 7/2005 | Teplitxky et al. | 340/572.8 |

FOREIGN PATENT DOCUMENTS

EP 0454967 A2 * 3/1991

* cited by examiner

*Primary Examiner* — Benjamin C Lee

*Assistant Examiner* — Cal Eustaquio

(74) *Attorney, Agent, or Firm* — John C. Thompson; Sandra J. Thompson

(57) ABSTRACT

The present invention relates to a container, especially for moisture-sensitive goods, with a container body formed by a wall and a bottom of the container, and a container cover which can be opened and closed. The container has a layer, preferably containing a desiccant, which extends over at least a part of the body and a transponder which is arranged between body and layer.

19 Claims, 2 Drawing Sheets

CONTAINER

CROSS-REFERENCE TO RELATED APPLICATIONS

This application claims foreign priority benefits under 35 U.S.C. §119 from European patent application Ser. No. 05 014 386.6 filed Jul. 1, 2005.

TECHNICAL FIELD

The present invention relates to a container for moisture sensitive goods, and more particularly to a container having a layer, preferably containing a desiccant, which extends over at least a part of the body, and a transponder which is arranged between body and layer.

BACKGROUND OF THE INVENTION

A container for moisture sensitive goods is known from EP 454 967. This container comprises a container body with a container wall and a container bottom, and a layer arranged internally in the container. In the case of the above container, this layer comprises a desiccant. Such a container is suitable for receiving drugs or other goods which have to be kept dry for a long time.

To allow tracking and tracing of the container comprising goods, it has been proposed to attach a radio frequency ID (RFID) transponder to the container. One proposal is to integrate the transponder in the container cover or container lid. However, the cover may be taken off and an inadvertent exchange may take place which prevents a correct identification of the container and its goods in question.

Another proposal was to attach a transponder by clips in a hollow bottom space protruding downward from the container. Such a construction prevents the container from being manufactured as usual, and it is not surprising that such a complicated structure has not been a commercial success. Also, the center of gravity of the container rises such that the container gets unstable. The container is not theft-proof as the transponder may be taken away easily, and the transponder itself is not tamper-proof.

A transponder is usually made from a RFID chip and an antenna. The antenna extends essentially flat and comprises a coil made from metal or metallized plastic material. The transponder is covered by thin plastic sheets on both of its sides. Due to its flat structure, which may be as thin as 20 μm, it is possible to attach the transponder on surfaces on any suitable containers. An example of such transponders for bottles may be taken from DE 200 10 351 U1.

OBJECTS AND SUMMARY OF THE INVENTION

It would be desirable to efficiently control the presence and types of drugs and other goods, both for economical and security reasons.

Thus, it is an object of the present invention to provide a container for moisture sensitive goods which is easy to manufacture and allows a safer handling.

More particularly it is an object of the present invention to provide a container with a layer, preferably containing desiccant, which extends over at least a part of the body, and a transponder which is arranged between the body and the layer.

Thus, the inventive container has a transponder including preferably a RFID chip safely received in a space which is adjacent to both the layer and the body of the container. Although the layer may be produced from any suitable material such as a plastic coating material, it advantageously comprises a desiccant. While usually the layer comprising desiccant material is used only from one side i.e. the inner side which extends towards the goods to be received within the container, according to the invention, the transponder is adjacent to its other side which was not used before. Accordingly, the transponder is both kept safe and dry such that inexpensive transponders may be used even without plastic sheets which are usually required for covering the transponders.

By arranging the transponder between container body and layer, the transponder is both protected and invisible but yet has a sufficient operability. In this regard, both the layer and the body are essentially made from plastic material which does not form any barrier for electromagnetic waves. The transponder may be made as a flat disc received close to the bottom of the body but it may also be received as a flat and arcuate sample extending between the layer and the body, close to the container wall. Preferably, the container has a generally cylindrical shape but any other shape such as rectangular or any other suitable geometric form may be used for the inventive arrangement.

It is preferred to provide the transponder in a flat area. In another preferred embodiment, the transponder antenna extends essentially flat while its RFID chip is received in a small recess which is provided in the body or in the layer. The overall thickness of the antenna may be as little as 10 μm while the chip may be produced in a suitable size which is easy to handle and to manufacture i.e. between 20 and 100 μm thickness.

It is preferred that the layer fully covers and seals the transponder against the drugs or other goods. Thus, the drugs do not get contaminated by any transponder material and also the transponder is protected against any substance which might by contained in the goods. On the other hand, the transponder is invisible as a user will not take notice that the overall bottom of the container has a slightly increased thickness, compared to the thickness of the wall of the container.

Advantageously, both the layer and the body may be manufactured in a well-known manner i.e. without any need to re-work the machining tools. Simply, the cup-shaped layer is inserted into the cup-shaped container body after the transponder is placed into it.

Any suitable information may be transmitted upon activation of the transponder. The RFID chip may be selected in any suitable manner, advantageously comprising a memory device. The information received and transmitted to the scanner may comprise any data regarding the goods received in the container, the production details etc.

In an advantageous embodiment, the container comprises a moisture sensor which may be embedded in the layer. This moisture sensor is electrically connected with the transponder such that it allows the transponder to transmit any moisture data. Thus, the customer may easily judge whether or not the humidity in the container is sufficient and an alarm may be given if humidity increases beyond a predetermined level.

In another embodiment which is suitable for very small containers, the antenna of the transponder extends separately from the RFID chip. One possibility is to integrate the antenna in the container body such that only the RFID chip of the transponder is received in the space between layer and body. This requires to rework the production of the container body such that this solution is not preferred for normal-sized containers. Yet it allows a tamper-proof arrangement of the RFID chip without leaving the scope of the present invention.

Advantageously, an inexpensive transponder may be used. Preferably, all elements of the transponder a fixed on a base sheet and altogether are arranged in a hollow space between the layer and the body. While the operation temperature range with former transponders was limited due to condensation water which occurs at low temperatures and may have a negative impact on the transponder, according to the invention, the desiccant material contained in the layer will prevent the generation of condensation water such that the temperature range of operation is extended.

Further details, advantages and features may be taken from the following description of two embodiments of the invention with reference to the drawings.

DETAILED DESCRIPTION

Figure 1:
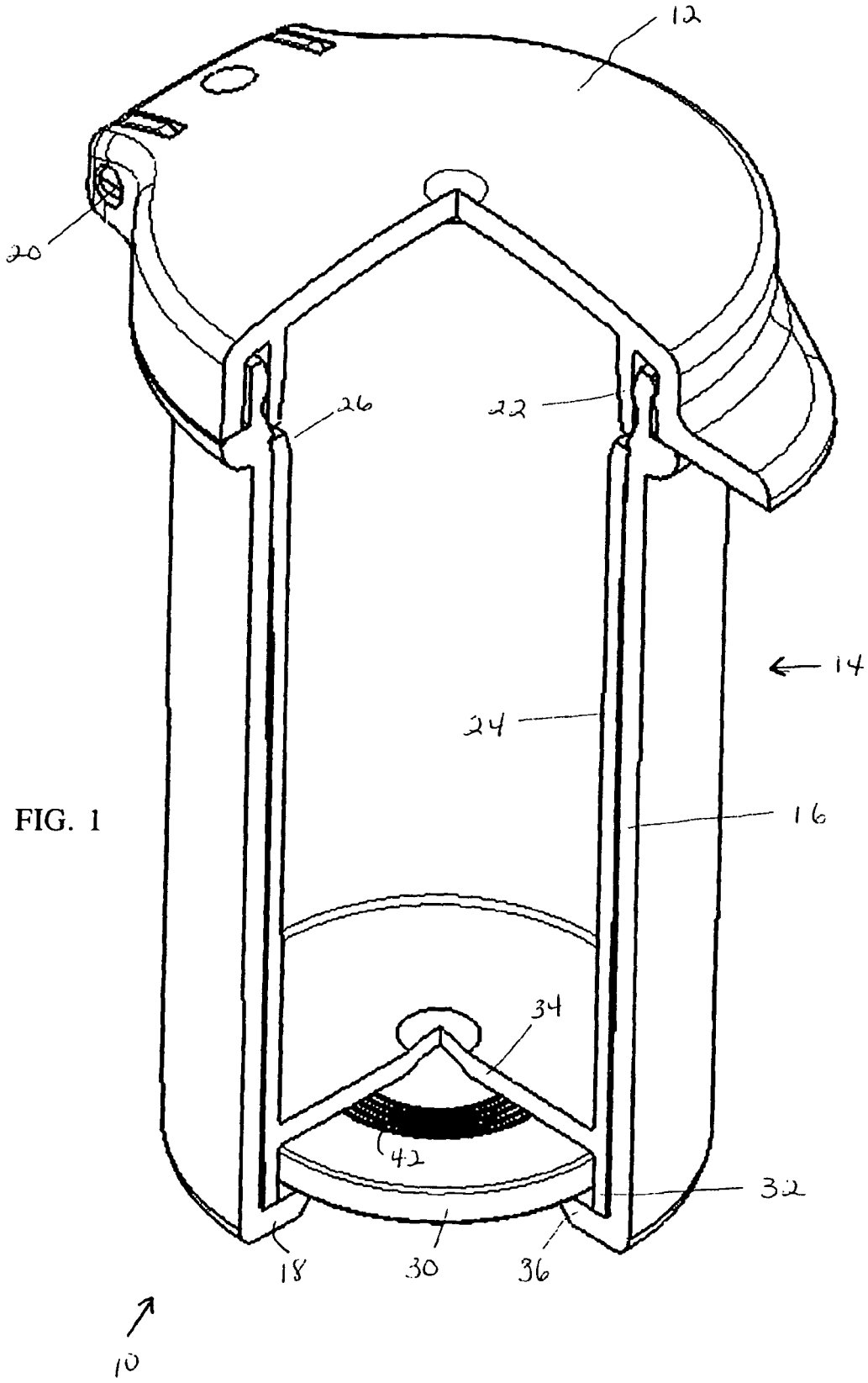
FIG. 1 is a perspective view of a container according to a first embodiment of the invention, cut into two pieces with the front piece broken away.

FIG. 1 shows a container 10 standing upright with the front half being cut away. The container has a cover 12 which may be opened and closed in a well-known manner. A body 14 of the container is essentially cylindrical and cup-shaped. The body 14 comprises a container wall 16 and a container bottom 18. Cover 12 is pivotally mounted at a hinge 20 on body 14, and seals at sealing line 22 against the container body 14.

Body 14 is internally covered by a layer 24 made from plastic material. Preferably, this layer contains desiccant, and preferably the layer is made from 2AP (2 absorbant polymers) as it is described in U.S. Pat. No. 5,432,214. Any other polymer composition may be used, and also molecular sieve or zeolite.

Layer 24 fully covers the bottom portion 34 and the wall portion 16 of body 14. It has an essentially equal thickness with the exception of its upper end. There, an oblique portion 26 facilitates insertion of goods like drugs etc. into the container.

According to the invention, a transponder 30 is received within a closed space between layer 24 and body 14. In the present embodiment, the transponder 30 is formed like a disc which covers bottom 18 and is received within a flange 32 which protrudes downward from a bottom portion 34 of layer 24. The transponder is held under pressure exerted between the layer 24 and the body 14 towards each other.

The transponder 30 may be built up in any suitable manner. Usually, a RFID chip is combined with a coil-shaped antenna but any other circuit may be selected which is able to send data about the identification of the container to a suitable receiver. Preferably, the transponder 30 does not comprise a power source but is activated by the electromagnetic energy received via its antenna. On the other hand, it is also possible to use a small battery if desired. Thus, the understanding of transponder is broader than usual here and shall also include a plain transmitter.

As may be taken from FIG. 1, the container bottom 18 has a receding center portion 36 which centrally improves the stability of the container. The container wall and bottom also have a uniform thickness which is slightly larger than the thickness of layer 24. In the present embodiment, the thickness of the container body 14 is about 50% larger than the thickness of layer 24 and the thickness of transponder 30 is about double the thickness of layer 24.

Preferably, the inventive container is mounted such that the cup-shaped layer 24 is turned upside down. Then the transponder 30 is inserted into the center portion of flange 32. Then, body 14 is firmly pushed over the arrangement of transponder 30 and layer 24. Preferably, there is a snap-fit connection between, and the layer 24 has a press fit within wall 16. By this, layer 24 cannot be inadvertently taken out, and the container is tamper-proof, all the more as transponder 30 is not visible. In this regard, it is preferred that at least the bottom 18 of container body 14 and the bottom portion 34 of layer 24 are not transparent.

Figure 2:
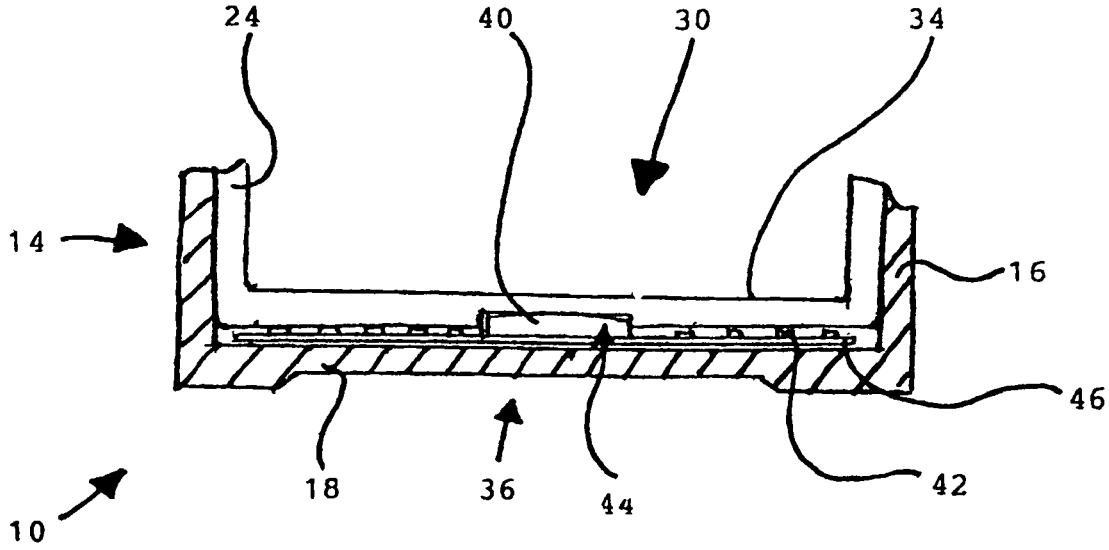
FIG. 2 is an enlarged sectional view of the transponder as received in the lower part of a container according to a second embodiment of the invention.

A further embodiment of the inventive container is schematically indicated in FIG. 2 which shows a sectional view of the lower portion of the container 10. The transponder 30 is received also between layer 24 and body 14 of the container. The transponder 30 comprises a RFID chip 40 and a coil-shaped antenna 42. The layer 24 has, at its bottom portion 34, a central recess 44 which is sized to receive chip 40. The transponder also comprises a plastic sheet 46 for mounting the antenna 40 and the RFID chip 40. There is no additional cover sheet, and both the chip and the antenna are kept dry by layer 24 which comprises desiccant. Sheet 46 is received on the flat upper surface of bottom 18.

This embodiment shown in FIG. 2 shows an even thinner construction of transponder 30. The sheet 46 may have a thickness of 10 μm and the antenna 42 may consist of a metal with a thickness of 15 μm such that the overall thickness—with the exception of the RFID chip—is only 25 μm. The transponder 30 is safely received and kept dry within container 10.

While a preferred form of this invention has been described above and shown in the accompanying drawings, it should be understood that applicant does not intend to be limited to the particular details described above and illustrated in the accompanying drawings, but intends to be limited only to the scope of the invention as defined by the following claims. In this regard, the term "means for" as used in the claims is intended to include not only the designs illustrated in the drawings of this application and the equivalent designs discussed in the text, but it is also intended to cover other equivalents now known to those skilled in the art, or those equivalents which may become known to those skilled in the art in the future.

What is claimed is:

1. Container for moisture-sensitive goods, with a container body (14) formed by a wall (16) and a bottom (18) of the container (10), and a container cover (12) which can be opened and closed, with a layer (24) having a bottom portion (34) interior to the wall (16) of the container (10), wherein the cover (12) initially covers at least a part of the body (14), characterized in that a transponder (30) is arranged in a hollow space formed by the bottom portion (34) of the layer (24) and the bottom (18) of the container, wherein the layer (24) has a desiccant thoroughly distributed therein and the transponder (30) is fully covered by the bottom portion (18) of the layer (24).

2. Container according to claim 1, characterized in that the bottom portion (34) of the layer (24) covers the bottom (18) of the container (10) where the transponder (30) is arranged, with the transponder (30) being fully covered by the bottom portion (34) of the layer (24).

3. Container according to claim 1, characterized in that the transponder (30) extends in a closed space left between the bottom portion (34) of the layer (24) and the body (14).

4. Container according to claim 1, characterized in that the transponder (30) is held under pressure exerted between the bottom portion (34) of the layer (24) and the body (14) towards each other.

5. Container according to claim 1, characterized in that the transponder (30) is in frictional engagement with the body (14) and/or the bottom portion (34) of the layer (24).

6. Container according to claim 1, characterized in that a recess (44) is provided in the bottom portion (34) of the layer (24) facing the body (14), or in the bottom (18) facing bottom portion (24) of the layer (24), and that the transponder (30), or at least a part of it, is received in said recess (44), and wherein said transponder is an RFID chip (40).

7. Container according to claim 1, characterized in that the layer (24) has an essential uniform thickness with a flange (32) extending in a recess (44) provided in the bottom (18) of the container (10), with the transponder (30) being received into said recess within said flange (32).

8. Container according to claim 1, characterized in that the transponder (30) comprises at least one coil made of metal or other electrically conductive material and that said coil is received between two plastic sheets (46) sealing against each other.

9. Container according to claim 1, characterized in that the transponder (30) comprises at least one coil made of metal or other electrically conductive material and being directly received between the layer (24) and the body (14).

10. Container according to claim 1, characterized in that the transponder (30) is received in a tamper-proof manner and is invisible between the layer (24) and the body (14).

11. Container according to claim 1, characterized in that the desiccant contained in the layer (24) desiccates the transponder (30).

12. Container according to claim 1, characterized in that the body (14) of the container (10) protects and covers the transponder (30) and that the transponder (30) is arranged adjacent to the bottom (18) of the container (10).

13. Container according to claim 1, characterized in that the transponder (30) is connected with a moisture sensor which is received within the container body (14) and which, upon activation, measures the humidity or moisture of the inner space of the container (10) which may be read out via the transponder (30).

14. Container according to claim 1, characterized in that the layer (24) is part of a cup-shaped, insert which is fully received within the body.

15. Container according to claim 14, characterized in that the insert is received in a body in a tamper-proof manner and cannot be taken out without destruction of the body (14) and/or of the layer (24).

16. Method for producing a container, with a container body (14), the method comprising:

forming the body with a wall portion (16) and a bottom portion (18) in a cup-shaped manner, placing a transponder (30) into the body (14), close to its bottom (18), providing a layer (24) having thoroughly distributed therein a desiccant, the layer also being cup-shaped and fitting into the body (14), inserting said layer into the cup-shaped body (14) thus covering the transponder (30), wherein the transponder (30) is arranged in a hollow space provided between the layer (24) and the body (14).

17. Method according to claim 16, further including inserting the cup-shaped layer into the cup-shaped body (14) to an extent that the transponder (30) is fixed by friction between layer (24) and body (14).

18. Method for producing a container, comprising:

providing a container body which is formed by a wall portion and a bottom portion (16, 18) in a cup-shaped manner, providing a layer (24) also formed in a cup-shaped manner having a bottom portion (34) and having a smaller diameter than the body (14), the layer having thoroughly distributed throughout a desiccant, placing a transponder (30) below and close to a bottom portion (34) of the layer (24), and pushing the container body (14) over the arrangement of transponder (30) and the layer (24) in a coaxial manner such that the transponder (30) is sandwiched between the layer (20) and the container body (14).

19. Method according to claim 18, further comprising inserting the cup-shaped layer into the cup-shaped body (14) to an extent that the transponder (30) is fixed by friction.

* * * * *